US005751226A

United States Patent [19]

Hretsina

[11] Patent Number: 5,751,226

[45] Date of Patent: May 12, 1998

[54] TAXIWAY MARKER

[76] Inventor: Gary Hretsina, 835 Westney Road South, Unit 12, Ajax, Ontario, Canada, L1S 3M4

[21] Appl. No.: 753,787

[22] Filed: Dec. 2, 1996

[51] Int. Cl.[6] ..... G08G 5/00; G02B 5/124

[52] U.S. Cl. ..... 340/947; 340/948; 340/908.1; 359/529; 359/530

[58] Field of Search ..... 340/471, 473, 340/907, 908, 908.1, 947, 953, 948; 359/531, 532, 534, 535, 529, 530; 404/14, 16; 116/63 R, 63 P, 63 T

[56] References Cited

U.S. PATENT DOCUMENTS

| | | | |
|---|---|---|---|
| 3,684,348 | 8/1972 | Rowland | 350/103 |
| 3,712,706 | 1/1973 | Stamm | 350/103 |
| 3,922,066 | 11/1975 | Schaefer | 404/12 |
| 3,969,621 | 7/1976 | Ferrell | 240/41.35 C |
| 4,202,600 | 5/1980 | Burke et al. | 350/103 |
| 5,115,343 | 5/1992 | Bennett | 359/529 |
| 5,223,977 | 6/1993 | Bennett | 359/530 |
| 5,237,449 | 8/1993 | Nelson et al. | 359/532 |
| 5,287,256 | 2/1994 | Bennett | 362/152 |
| 5,335,112 | 8/1994 | Bennett et al. | 359/530 |
| 5,354,143 | 10/1994 | Lindner | 404/14 |
| 5,392,728 | 2/1995 | Speer et al. | 116/63 R |
| 5,416,636 | 5/1995 | Bennett | 359/529 |
| 5,470,170 | 11/1995 | Lindner | 404/14 |
| 5,501,545 | 3/1996 | Walter | 404/14 |
| 5,557,460 | 9/1996 | Bennett | 359/530 |

*Primary Examiner*—Brent A. Swarthout
*Assistant Examiner*—Van T. Trieu

[57] ABSTRACT

A marker comprises a metal sheet bent to curve about an axis and forming, in sector perpendicular to said axis a hairpin turn and where there are median extents on each side, approximating in the sheet planar panels, defining an angle of 0°–30° to each other and having on their convex side, a retroreflectant layer.

6 Claims, 4 Drawing Sheets

TAXIWAY MARKER

This invention relates to a marker for taxiways, roads or the like. Although there are many uses for such a marker, its most common use is thought to be as a boundary marker for an aircraft taxiway.

The marker, at least for taxiway use should be generally vertical, and retroreflectant for vehicles or aircraft approaching from either direction on the taxiway. Hereafter, by 'vehicle' I include a taxiing aircraft. The retroreflectance tends to cause a higher degree of light to be retroreflected to vehicles approaching from either direction.

By 'taxiway' I include a roadway.

The best prior marker design known to us is our U.S. Pat. No. 5,287,256 ('256) dated Feb. 15, 1994 and assigned to Reginald Bennett International Inc. which discloses a marker with a retroreflectant sleeve.

Although such marker has been practical there is here presented a retroreflectant marker suitable to two way travel of vehicles therepast and more visible than the '256 patent and other prior art both in the general sense and in the sense that it stands out more clearly against a background which may be a melange of other lights forming a confusing background, and is better than the marker of the '256 patent in that it tends to guide the receiver of its rays toward the centre of the taxi or roadway.

In accord with the present invention, there is provided a marker comprising a metal sheet bent to curve about an axis and forming in section perpendicular to said axis a hairpin turn and where there are median extents on each side, approximating in the sheet planar panels, defining an angle of '0°–30° to each other and having on their convex side, a retroreflectant layer.

Preferably the retroreflectant layer is an aluminized polycarbonate tape.

In a preferred aspect of the invention, the retroreflectant area is covered with retroreflecting material which gives a brighter retroreflection for incident light normal to the plane of the reflection than it's retroreflection for light incident at another angle. Thus retroreflecting material and normally reflecting material will give a higher degree of retroreflectivity to normally incident light but the relative drop in retroreflectivity, for non-normal angles of incident light, will be greater with ordinary reflective material than with retroreflective. Thus for a vehicle approaching the marker from directions other than normal to a reflectant area, the marker with retroflectant material is easier for the pilot to detect.

With retroreflectant material, the driver of an approaching vehicle receives, whatever his approach angle, a brighter reflection of his lights than with an ordinary reflector, and because of a quality of the preferred retroreflector, tends to receive the brightest reflection when he is on the correct path. Thus the driver may use the reflection intensity as his guide toward finding and following the correct path.

By the term "aluminum" herein, including in the claims, I mean to include alloys of aluminum.

In a preferred aspect of the invention the panels carrying the retroreflectant material, (and preferably the whole marker (other than the retroreflectant layers)) are made of aluminum. A particular advantage of aluminum in this invention is that aluminum has nearly the same coefficient of thermal expansion as the preferred retroreflectant material (polycarbonate with aluminized coating) which is preferably applied as a layer to the panel. The preferred retroreflectant material is an aluminized polycarbonate tape sold under the trademark Reflexite. Considering the fact that the reflector in accord with the invention should be designed to withstand a temperature range of −40° to +50° C., the effects of differential thermal expansion between the body of the reflector and the reflectant surface are material and in many situations the use of aluminum alloys is found the best way to avoid buckling or tearing of the retroreflectant material, since the thermal expansion coefficient of aluminum or aluminum alloys is close to that of the preferred retroreflectant material.

The cube corner reflectant material known as Reflexite is made in accord with the teaching of U.S. patents listed below which are incorporated herein by reference:

| | |
|---|---|
| 2,380,441 | Jungerson |
| 3,712,706 | Stamm |
| 3,684,348 | Rowland |
| 3,810,804 | Rowland |
| 4,025,159 | McGrath |
| 4,202,600 | Burke |

The teachings of the above patents are incorporated herein by reference.

In particular the invention preferably makes use of cube corner reflective sheeting as described in the Burke U.S. Pat. No. 4,202,600 where regular arrays of cube corner reflectors in sheets are arranged in zones (indistinguishable to the user) oriented relative to adjacent zoners in such a way that retroreflective intensity variation with azimuthal angle (measured in the plane of the sheet), is reduced at high angles of incidence to the normal to the sheet.

By an array is meant an ordered group of cube corner triads. A 'zone' is the area occupied by such an array.

The invention takes advantage of the fact that retroreflectant material composed of arrays of cube corner reflectors (which are not individually distinguishable at minimum expected viewing distances) customarily retroreflect, incident light more strongly at a normal angle of incidence than at other angle of incidence.

It is noted that with all cube corner reflector arrays there is some directivity in the strength of the secondary reflection. That is for a given array zone the secondary reflection will be stronger in some azimuthal directions relative to the normal than others. This is of course more noticeable with a single array where all triads have an ordered orientation relative to each other. It will also be noted that the cube corner reflector array zones which are taught by U.S. Pat. No. 4,202,600 and preferred for use with the invention, are too small for resolution by the viewer so that the actual orientation of individual zones of the reflecting surface is not known when a sheet bearing the reflectant coating is applied. Thus it is preferable if the cube corner reflector sheet is divided into zones (indistinguishable at usual viewing distances) which are differently oriented relative to each other tending to give a more uniform reflection at large angles to the normal and at varying azimuthal angles about the normal.

Preferably the cube corner cavity material is that sold under the trade mark REFLEXITE, a product of the Reflexite Corporation of New Britain, Conn. Such material is a polycarbonate with an aluminized coating. In such product the cube corner cavitites are arranged in windows formed by triads of mutually perpendicular cube faces in an ordered array with a predetermined orientation. Such ordered arrays are in zones small enough to be indistinguishable to the viewer at minimum normal viewing distances. The zones are preferably arranged to have two orientations at 90° to each other arranged in a checkerboard or other pattern. The REFLEXITE material customarily is supplied in rolls with a self adherent backing.

In a preferred aspect of the invention the marker provides, in plan, a prism or wedge shape. Thus the markers may be placed on each side of a taxiway with the narrow end of the wedge approximately perpendicular to the surface and pointing at the narrow end of an opposing marker on the other side of the taxiway.

With this arrangement the vehicle operating on the taxiway may compare the retroreflections from markers on the opposite sides of the taxiway. The markers, may, if desired, be arranged and oriented so that the vehicle operator may tell from the relative brightness of the retroreflections, whether his vehicle is centred or on the correct side of the taxiway. The markers are shaped to provide the desired retroreflectivity for vehicles travelling in each direction. The markers preferably also provide an apex with a convex outward retroreflectant are which indicates to the vehicle operator the presence of a marker as the vehicle is passing directly in front of it.

Preferably the angle between the reflectant panels is selected having regard to the taxiway width, and usually for maximum reflection at the centre of the runway. For this reason, we most commonly use an angle of about 17° between panels. The angle of about 17° may also be thought of as an exterior angle of about 343° between the retroreflectant sides.

The marker is preferably adapted to be mounted with its axis perpendicular to the support surface on which it rests so that the panels tend also to be perpendicular to the support surface. The supported panel may be designed to rest on or be fastened in the desired orientation to the runway surface or just outside its edge. The marker may equally be provided with screw or other means for mounting on one or another mount. Thus any mounting is within the scope of the invention.

The preferred form of the invention involves a convex outward reflector connecting the two reflector panels. In this way the marker may be noted when passing in front of its narrow end.

In a preferred form of the invention a support for the sheet, wedge shaped in plan view, defines the desired panel and narrow end shape for the sheet. The sheet is in a rest attitude defines hairpin angle wider than its final position. Thus the wider angle assists in the application of the sheet to the support and the stressing of the sheet to narrow the angle when fastening to the support stiffens the sheet and strengthens the marker.

In drawings which illustrate a preferred embodiment of the invention:

DESCRIPTION OF THE PREFERRED EMBODIMENT

Figure 1:
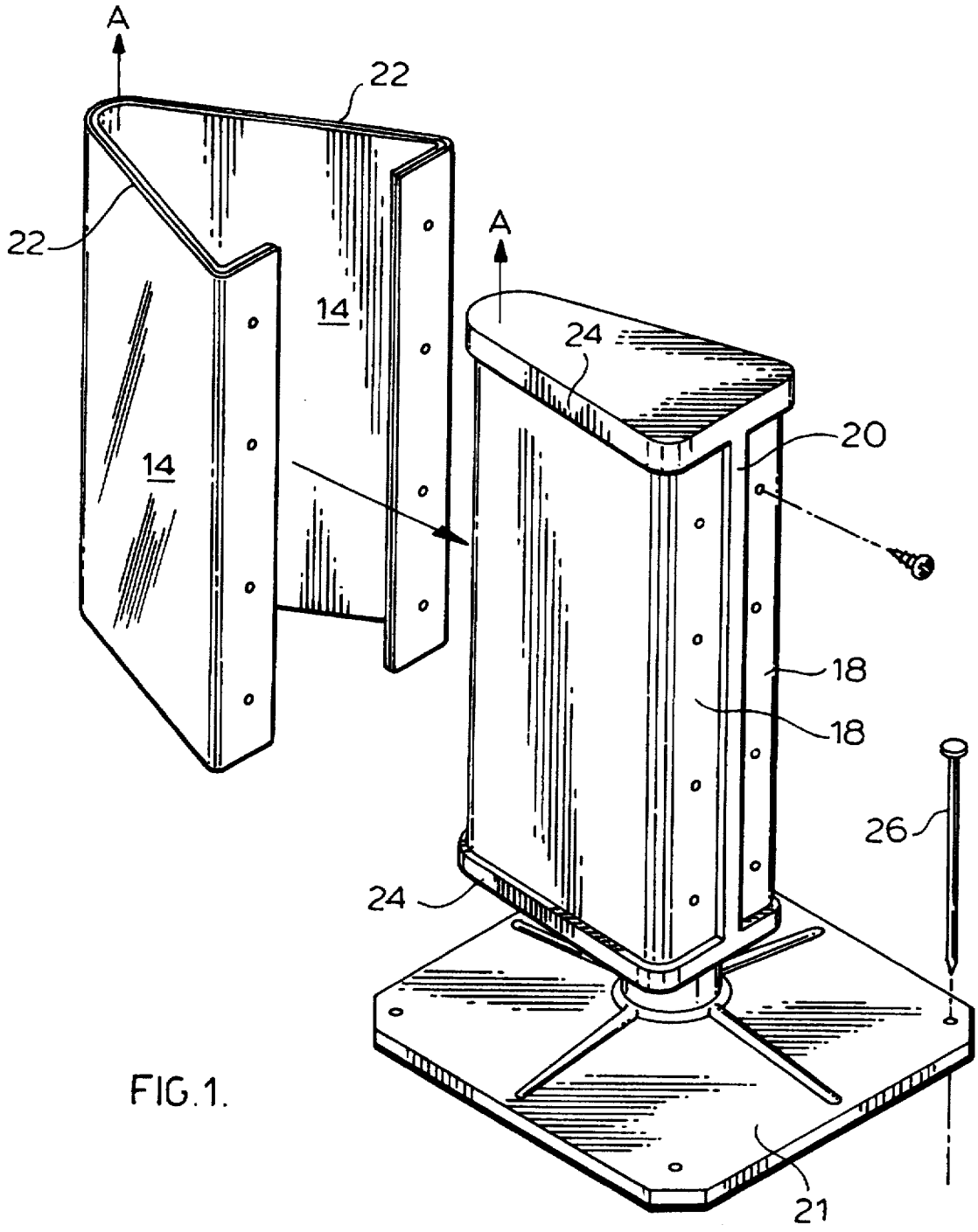
FIG. 1 is an exploded view showing the bent sheet, spread in its rest position (wider than its final position) the sheet support and the marker support.

In the drawings is shown a support 10, for the retroreflecting sheet 12, comprising a central body having a shape, in section, desired for the retroreflecting sheet, that is a pair of generally straight extents 14 in section at an angle of 0°–30° joined by a hairpin turn 16 which defines the axis A. The section preferably remains constant along the body's length along axis A. Such length usually corresponds to the height of the sheet.

On the flat 'wide end' of the wedge, the support defines flat areas 18 for (preferably) screw attachment of the metal sheet thereto. The wide end has a vertical outstanding rib 20 which side edges of the sheet may abut. Above and below the sheet edges 22 the support is enlarged at edges 24 which lends a pleasing appearance to the marker and also guides the sheet into position on the support.

Figure 2:
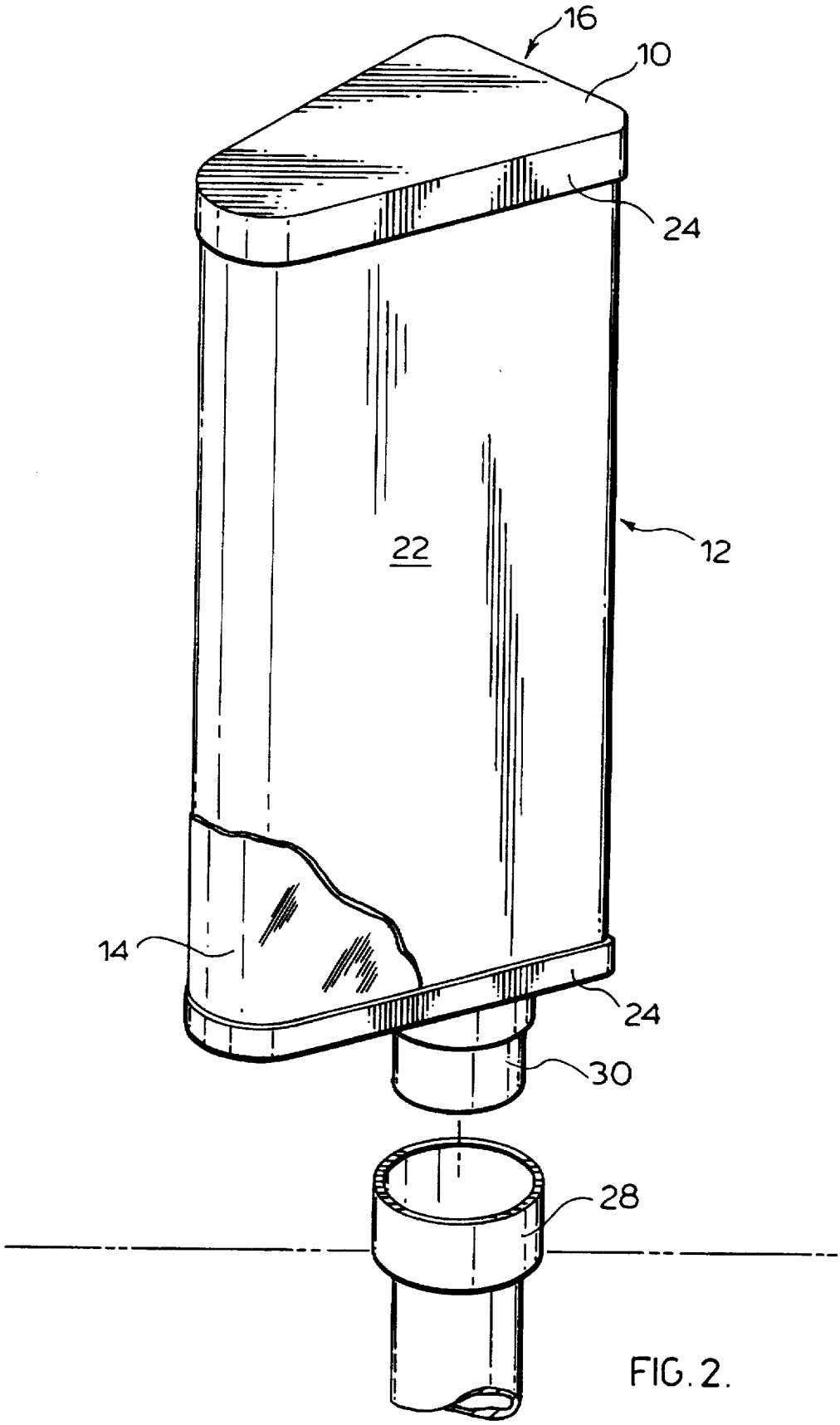
FIG. 2 is an assembled view of a marker with a different marker support to that of FIG. 1.

The base may be of any desired type. It will generally be desired to provide that the axis A be perpendicular to the median plane of the taxiway or roadway being marked by the marker. As shown, support means may include a base 21 for resting the marker on the taxiway or the ground on either side thereof, or may include means for attaching the base by spikes 26 or screw (or otherwise) mounting the base on a marker support, such as the socket 28 and core 30 of FIG. 2.

The metal sheet 12 is preferably made of aluminum for reasons to be explained. The retroreflectant tape 32 (preferably polycarbonate tape) sold under the trademark Reflexite)) is applied to the sides of the sheet which will be convex outwardly on the marker. The Reflexite tape has a very similar linear thermal coefficient to aluminum so that with these markers which must undergo climatic changes of from −50° to 50° tearing and wrinkling are avoided if aluminum is used.

The width of the sheet will be chosen to provide that the sheet will preferably extend down both marker walls 14 and along the back to the rib 20. The sheet is also chosen to be resiliently bendable from a rest position. Accordingly the sheet is bent so that in the rest position, the angle between opposed sides 14 is greater than in the fastened position (see FIG. 1) and flanges 18 at each side edge are adapted to extend to the spline. The flanges are preferably provided with mounting screws for attachment to the wide end panels.

Figure 3:
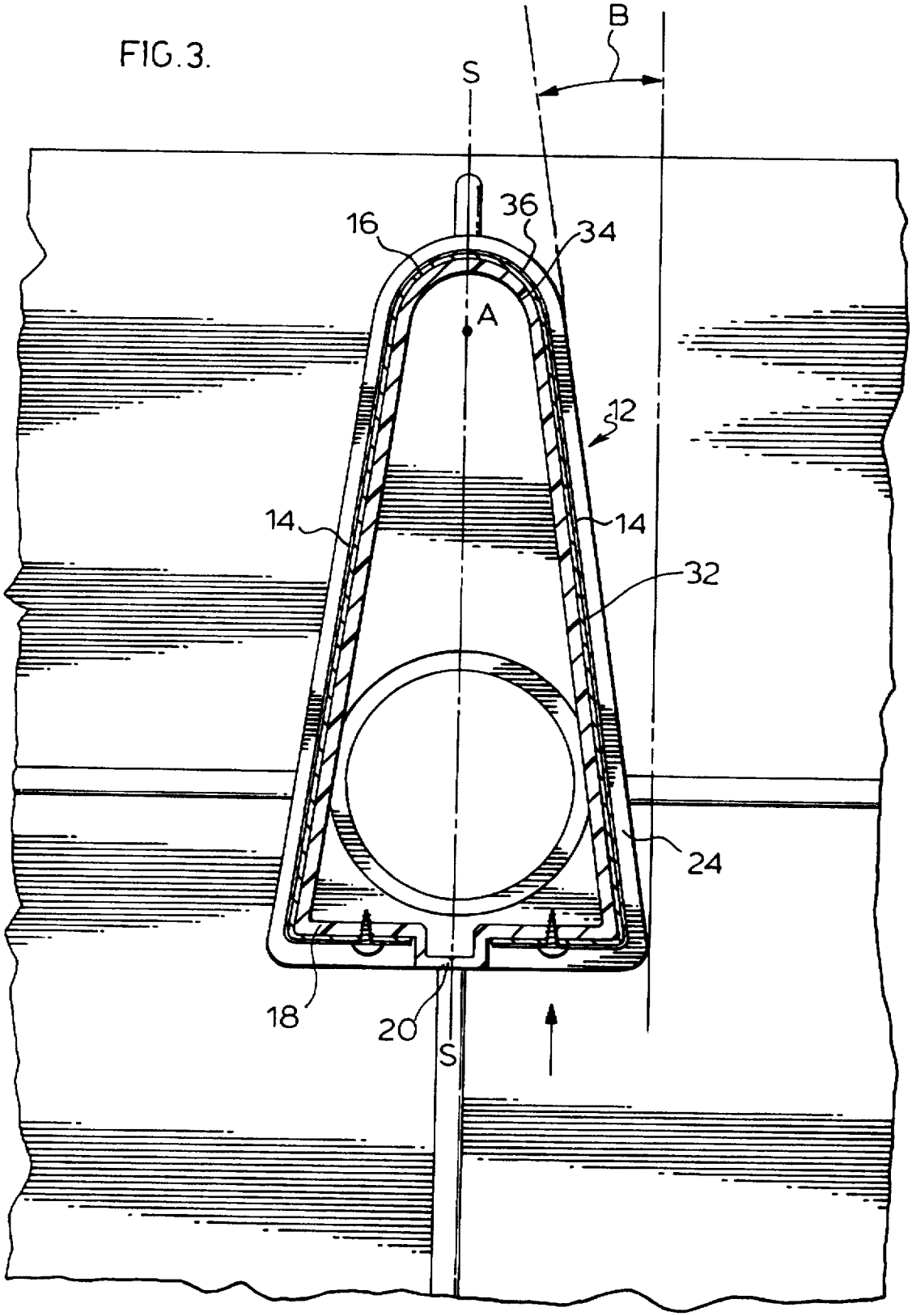
FIG. 3 is a section taken parallel to the support surface in the normal orientation of the device.

Accordingly the sheet in rest position more widely spread than in fastened position is applied in the direction from about the narrow end, until the hairpin curve 34 on the convex support surface nests in the concave hairpin curve 36 in the inside of the metal sheet. The flanges may then be fixed in position. FIG. 3 shows the angle B between extent 14 and the axis of symmetry S. Thus an angle of 2B represents the angle between extents 14.

Although the preferred method of forming the marker is described, any other method of providing a support to shape the retroreflecting sheet is within the scope of the invention. 'Upward' and 'Downward' herein are considered to be measured parallel to the axis of curvature and 'Horizontally' in a plane at right angles to the exis.

In fact the marker may be used in any orientation, but its most common orientation will be with the axis A perpendicular to the surface of a roadway or taxiway with which it is used.

Figure 4:
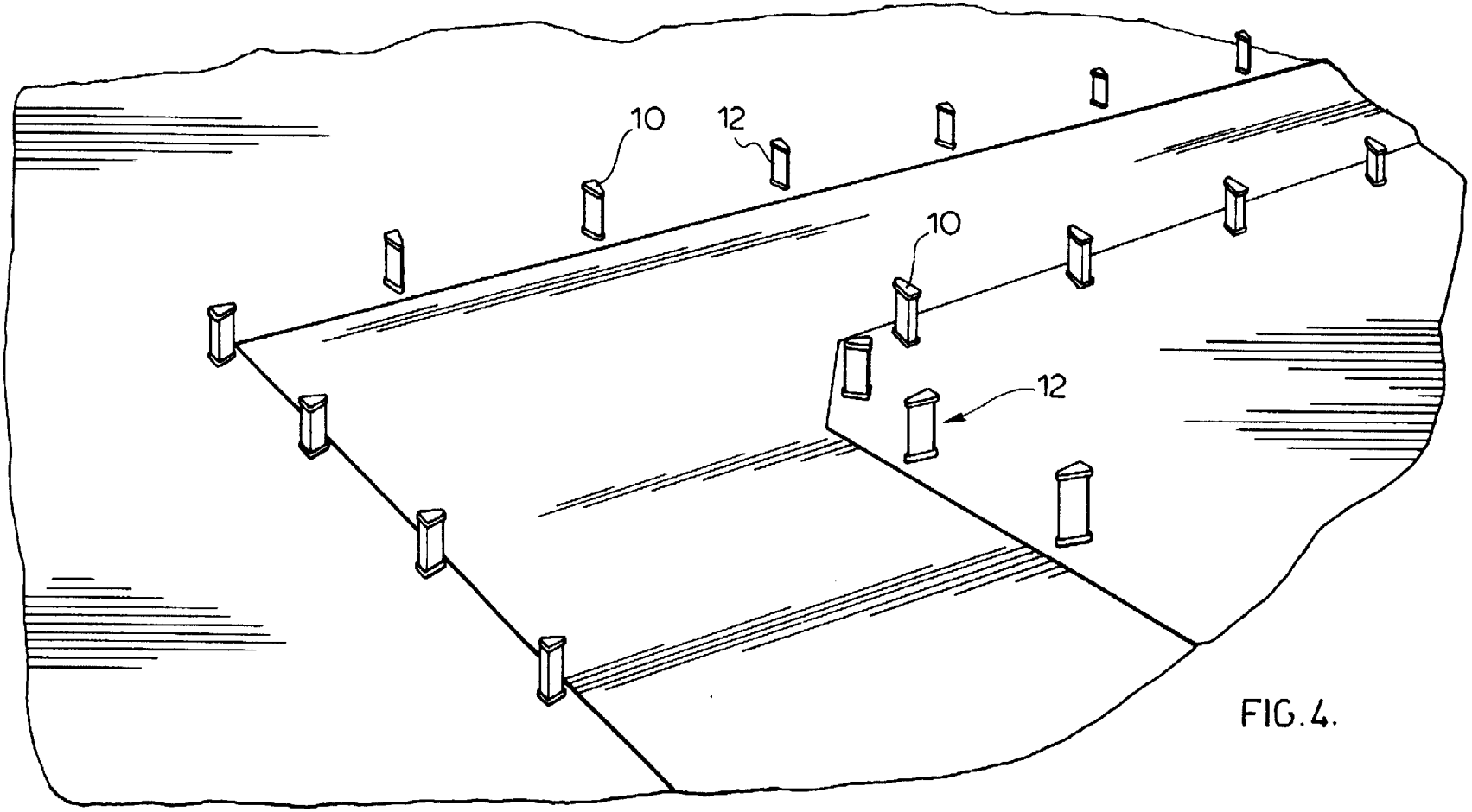
FIG. 4 is a schematic indication of markers as marking on a taxiway.

FIG. 4 shows a taxiway having onstraight extents opposed markers oriented to form opposed pairs so that the operator of the taxiing vehicle or aircraft will see lights of the vehicle, retroreflected from the markers giving the strongest retroreflection to line normal to a marker face.

I claim:

1. A marker comprising a metal sheet bent to form a hairpin turn and relatively flat areas on each side thereof making an angle of 0°–30° with each other, a retroreflectant layer on the convex side of said turn and on the corresponding side of said flat areas, support for said sheet.

2. A marker as claimed in claim 1 wherein said metal is aluminum and said retroreflectant layer is an aluminized polycarbonate tape.

3. A marker as claimed in claim 1 wherein said angle is about 17°.

4. A marker as claimed in claim 1 wherein said support has an exterior surface which conforms approximately to that of said sheet, wherein said sheet when unconnected has a rest attitude where said panels are in rest attitude wider than in fastened position and are resiliently based into position on said support.

5. A marker defining an axis, means for mounting said marker with an axis approximately perpendicular to a support surface, a said marker including a pair of approximately planar panel sections with said planar sections approximately parallel to said axis and at an angle of 0°–30° to each other, each of said panels defining a retro-reflective surface on the exterior side of said panels, a support for said panels, wherein the material of said panel sections extends to form a hairpin turn between said sections, wherein said retro reflective surface extends over the convex side of said hairpin turn.

6. A marker as claimed in claim 5 wherein said sections are of aluminum sheet, and said retroreflective surface is an aluminized polycarbonate tape.

wherein the material of said panel sections extends to form a hairpin turn between said sections, wherein said retro reflective surface extends over the convex side of said hairpin turn.

* * * * *